US005125349A

United States Patent [19]

Koie et al.

[11] Patent Number: 5,125,349

[45] Date of Patent: Jun. 30, 1992

[54] BUTTONHOLE SEWING MACHINE

[75] Inventors: Kazuaki Koie, Tokoname; Hideo Ando, Kounan; Akihiro Funahashi, Nagoya, all of Japan

[73] Assignee: Brother Kogyo Kabushiki Kaisha, Nagoya, Japan

[21] Appl. No.: 763,565

[22] Filed: Sep. 23, 1991

[30] Foreign Application Priority Data

Oct. 8, 1990 [JP] Japan ..... 2-271475

[51] Int. Cl.[5] ..... D05B 3/08; D05B 21/00

[52] U.S. Cl. ..... 112/66; 112/68; 112/73; 112/447; 112/264.1; 112/121.12

[58] Field of Search ..... 112/73, 65, 66, 68, 112/70, 76, 446, 447, 448, 449, 264.1, 121.12

[56] References Cited

U.S. PATENT DOCUMENTS 4,159,685 7/1979 Wurst et al. ..... 112/447

4,501,207 2/1985 Miyazaki et al. ..... 112/121.15 X 4,502,401 3/1985 Asai et al. ..... 112/447

4,727,817 3/1988 Sakuma ..... 112/73 X

FOREIGN PATENT DOCUMENTS 1-12709 4/1989 Japan .

*Primary Examiner*—Peter Nerbun

*Attorney, Agent, or Firm*—Oliff & Berridge

[57] ABSTRACT

In a sewing machine for creating buttonholes, a selection switch is used to designate whether the hole will be cut first or the buttonhole will be defined by stitching first. In both cases, stitch width remains constant. Where the buttonhole is outlined by stitches first, a needle bar bight line is offset by a distance ΔX from the bight line followed when the buttonhole is cut first. The result of the ΔX offset is a spacing equal to 2ΔX between the inner edges of the stitched buttonhole providing space in which to cut the buttonhole.

15 Claims, 9 Drawing Sheets

BUTTONHOLE SEWING MACHINE

BACKGROUND OF THE INVENTION

1. Field of the Invention

The invention relates to a buttonhole sewing machine for forming a cutout through a work fabric by means of a cutting mechanism and forming a zigzag stitch around the periphery of the cutout.

2. Description of Related Art

Referring to FIG. 7, a conventional buttonhole sewing machine for forming an eyelet type buttonhole forms a cutout 2 through a work fabric 1. The cutout 2 consists of an eyelet portion 2*a* and a straight portion 2*b*. Hereinafter, this type of cutout 2 is referred to as an eyelet hole 2. After forming eyelet hole 2, the buttonhole sewing machine automatically forms a continuous zigzag stitch 3 around the periphery of the eyelet hole 2 in the order shown by arrows A, B, and C in FIG. 7, that is, firstly on the right side of the straight portion 2*b*, secondly around the eyelet portion 2*a*, and finally on the left side of the straight portion 2*b*.

The buttonhole sewing machine has an arm and a bed. The arm is provided with a needle bar that is moved vertically and swung side to side by a driving mechanism.

The bed is provided with a looper driven in synchronization with the needle bar by a driving mechanism. On the bed, there is provided a feed table on which the work fabric 1 is set. The feed table is moved by a feeding mechanism.

The bed is further provided with a cutting mechanism for forming the eyelet hole 2. The cutting mechanism includes a lower knife and a hammer. The lower knife is fixed at a position spaced apart from the looper and has a cutting blade corresponding to the shape of the eyelet hole 2. The hammer is driven toward the lower knife by an air cylinder.

The buttonhole sewing machine is controlled by a control device including a microcomputer. Under the control of the control device, the buttonhole sewing machine forms the eyelet hole 2, shown in FIG. 7, through the work fabric 1 set on the feed table by means of the cutting mechanism.

Further, as shown in FIG. 8A, the buttonhole sewing machine moves the feed table, on which the work fabric 1 is set, by the feeding mechanism in such a manner that a center of swing of the needle bar moves, relative to the feed table, along a two-dot chain line a (which will be hereinafter referred to as a zero bight line a), and simultaneously drives the needle bar and the looper by the driving mechanisms. As a result, the zigzag stitch 3 is formed around the periphery of the eyelet hole 2 thus forming the eyelet type buttonhole. In forming the zigzag stitch 3 around the semi-circular portion corresponding to an upper half of the eyelet portion 2*a*, as shown in FIG. 8A, the looper and the needle bar are integrally inverted in a counterclockwise direction as viewed in top plan.

In carrying out the buttonhole sewing as mentioned above, a pre-cutting mode is generally adopted wherein the eyelet hole 2 is formed before formation of the zigzag stitch 3. In the pre-cutting mode, as shown in FIG. 8A, a needle bar swing width or zigzag width L1 is preliminarily set so that left needle location points b of the zigzag stitch 3 formed on the right side of the straight portion 2*b* of the eyelet hole 2 may substantially coincide with right needle location points b of the zigzag stitch 3 formed on the left side of the straight portion 2*b*. Further, in the pre-cutting mode, inside needle location points b of the zigzag stitch 3 formed around the periphery of the eyelet portion 2*a* fall inside the eyelet portion 2*a*. According to the pre-cutting mode, a peripheral edge of the eyelet hole 2 is covered with the zigzag stitch 3 to thereby obtain a buttonhole having a good appearance.

The pre-cutting mode as mentioned above is adopted for the formation of a buttonhole in the case where the work fabric is formed of a normal fabric material. However, when the work fabric 1 is formed of a fabric material such as a knit which is liable to ravel, it is desirable to adopt an after-cutting mode wherein the eyelet hole 2 is formed after the formation of the zigzag stitch 3.

In the after-cutting mode, the zigzag stitch 3 must be formed so that it is not cut by the cutting mechanism when the eyelet hole 2 is formed. Accordingly, as shown in FIG. 8B, a space must be defined between the left needle location points b of the zigzag stitch 3 formed on the right side of the straight portion 2*b* of the eyelet hole 2 and the right needle location points b of the zigzag stitch 3 formed on the left side of the straight portion 2*b*. Further, the inside needle location points b of the zigzag stitch 3 formed in the periphery of the eyelet portion 2*a* of the eyelet hole 2 must fall outside the eyelet portion 2*a*. To this end, in the after-cutting mode, the zigzag width is changed into a value L2 smaller than the zigzag stitch L1 in the pre-cutting mode with the feeding operation of the feed table along the zero bight line a being identical to that of the pre-cutting mode. Further, as shown in FIGS. 8A and 8B, the forming position of the eyelet hole 2 for the after-cutting mode deviates a distance $\Delta Y$ from that used in the pre-cutting mode. Therefore, it is necessary to adjust the position of the lower knife by the distance $\Delta Y$ prior to cutting.

However, in such a buttonhole sewing machine, the driving mechanism for the needle bar is such that rotation of a main shaft is converted into swinging of the needle bar through a needle swinging cam, a cam follower, a driving lever, and a link mechanism. Accordingly, in changing the zigzag width, an operator must operate a zigzag width adjusting mechanism, provided in a portion of the link mechanism, to carry out the fine adjustment of the zigzag width. This fine adjustment is very troublesome and requires much time. The result is a major inconvenience when selecting the pre-cutting mode or the after-cutting mode.

SUMMARY OF THE INVENTION

An object of the present invention is to provide a buttonhole sewing machine which can easily carry out the selection of the pre-cutting mode or the after-cutting mode without the inconvenience and consumption of time.

To achieve the object, a bottonhole sewing machine according to the present invention comprises: a feeding means for moving a feed table on which a work fabric is set; a needle bar driving means for both vertically moving and horizontally swinging a needle bar having a needle at a lower end thereof; a looper driving means for driving a looper in synchronization with the needle bar; a cutting means for forming a cutout through the work fabric set on the feed table; select means for selecting one of a pre-cutting mode where the cutout is formed before formation of a zigzag stitch and an after-cutting mode where the cutout is formed after formation of the zigzag stitch; control means for controlling the cutting means to form the cutout through the work fabric and thereafter controlling the feeding means, the needle bar driving means and the looper driving means to form the zigzag stitch having a predetermined width on opposite sides of the cutout when the pre-cutting mode is selected by the select means, while controlling the feeding means, the needle bar driving means and the looper driving means to form the zigzag stitch having the predetermined width on opposite sides of a position where the cutout is to be formed and therafter controlling the cutting means to form the cutout through the work fabric at the position when the after-cutting mode is selected by the select means; and offset means for offsetting the feed table in such a direction that stitches to be formed on the opposite sides of the position where the cutout is to be formed are spaced apart from each other, before the zigzag stitch is formed, when the after-cutting mode is selected by the select means.

In the buttonhole sewing machine of the present invention, when the pre-cutting mode is selected by the select means, a cutout is first formed through a work fabric, and thereafter a zigzag stitch having a predetermined width is formed on opposite sides of the cutout. In contrast, when the after-cutting mode is selected by the select means, a zigzag stitch having the predetermined width is first formed on opposite sides of a position where the cutout is to be formed through the work fabric, and thereafter the cutout is formed through the work fabric at this position. In the after-cutting mode, the feed table is offset by the offset means in such a direction that the stitches are formed on the opposite sides of the position where the cutout is to be formed. Accordingly, a non-sewn portion permitting the formation of the cutout can be formed between the stitches on the opposite sides of the position where the cutout is to be formed without changing a needle bar swinging width or zigzag width.

As described above, according to the buttonhole sewing machine of the present invention, the selection from the pre-cutting mode to the after-cutting mode is automatically followed by the offsetting of the feed table to be effected by the offset means. Accordingly, the zigzag width need not be changed in selecting one of the modes. Thus, the selection of the pre-cutting mode or the after-cutting mode can be carried out easily without the inconvenience and time consuming adjustment of stitch width.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 6A:
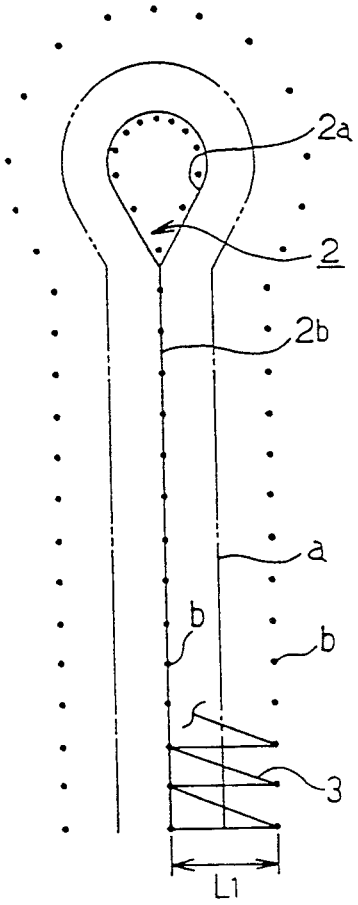
FIG. 6A is a view illustrating a relationship between a forming position of an eyelet hole through a work fabric and a position of needle location points in the case of the pre-cutting mode.
Figure 6B:
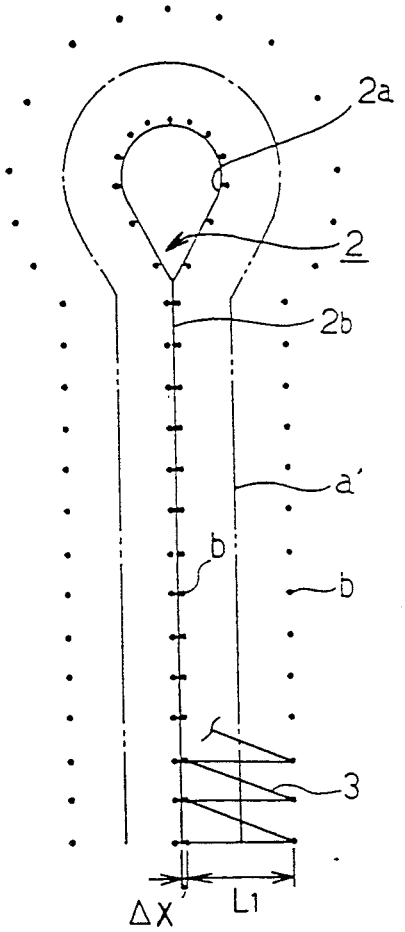
FIG. 6B is a view similar to FIG. 6A, in the case of the after-cutting mode.
Figure 7:
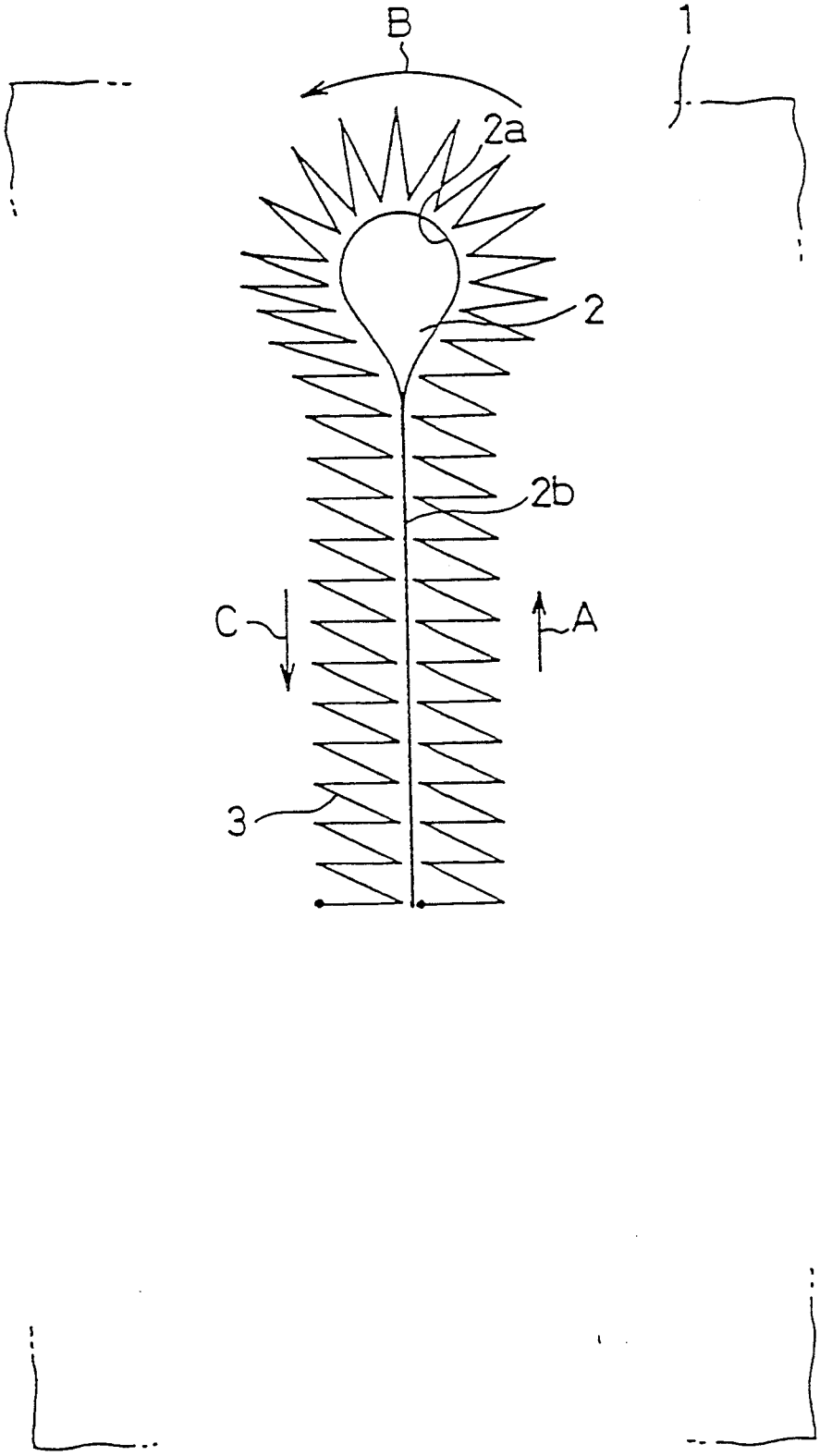
FIG. 7 is a plan view of the work fabric to which the buttonhole sewing has been applied.
Figure 8A:
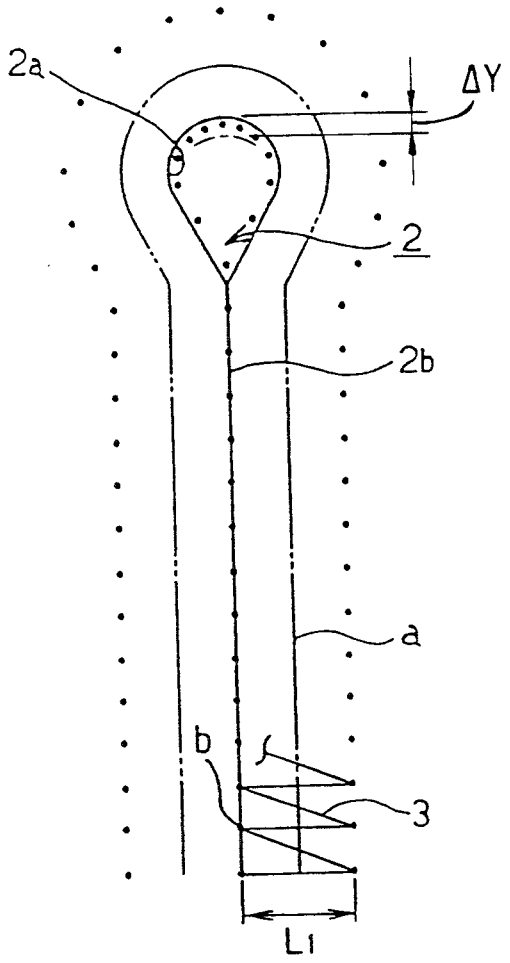
Fig.8A PRIOR ART
FIG. 8A is a view similar to FIG. 6A showing the prior art.
Figure 8B:
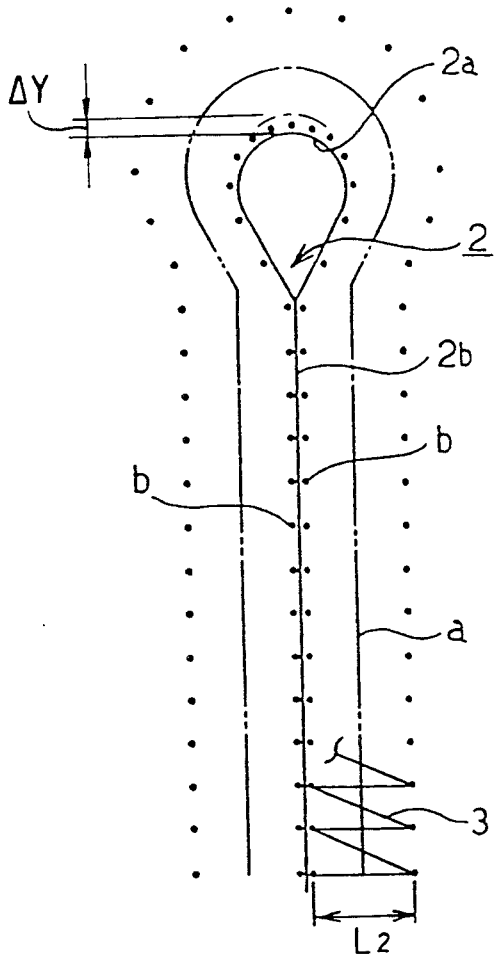
Fig.8B PRIOR ART
FIG. 8B is a view similar to FIG. 6B showing the prior art.

There will now be described a preferred embodiment of the invention applied to an eyelet type buttonhole sewing machine, with reference to FIGS. 1 to 7. In this preferred embodiment, a work fabric 1, an eyelet hole 2 and a zigzag stitch 3 as shown in FIG. 7, are similar to those previously mentioned in "Description of Related Art". It is therefore omitted to newly illustrate these elements, and reference numerals designating these elements will be used commonly in the following description.

First, the structure of the eyelet type buttonhole sewing machine will be described with reference to FIGS. 1 and 2. A machine body 4 has a bed 5 configured in a substantially rectangular box-like shape and an arm 6 integrally provided on the bed 5. The machine body 4 is placed on a machine table 7. The machine table 7 is provided with a machine motor 8, an operation panel having a select switch 9, a foot-operated start/stop switch 10, and a control device 14, the last three of which will be hereinafter described with reference to FIG. 4.

Figure 1:
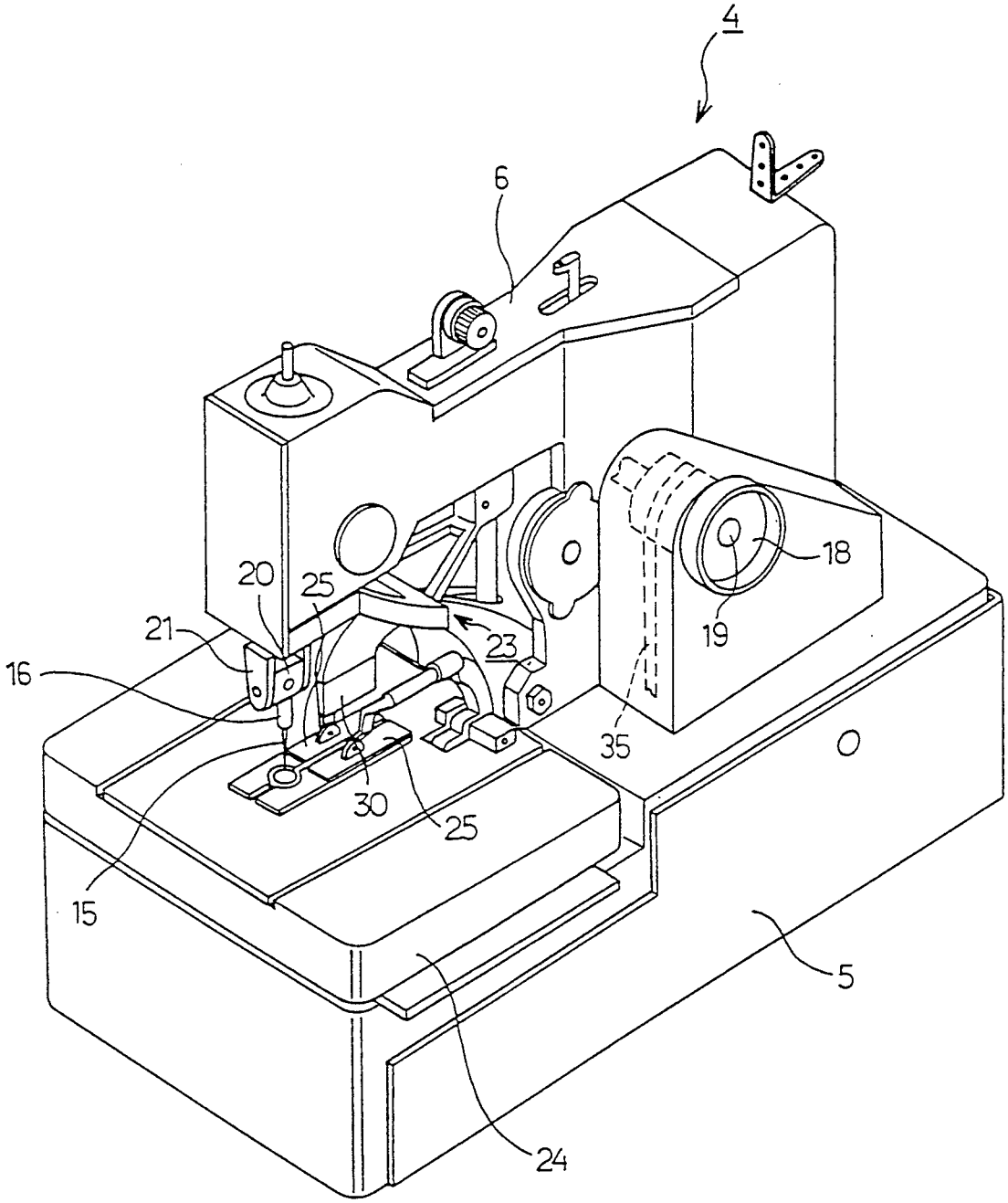
FIG. 1 is a perspective view of the buttonhole sewing machine according to a preferred embodiment of the invention.
Figure 2:
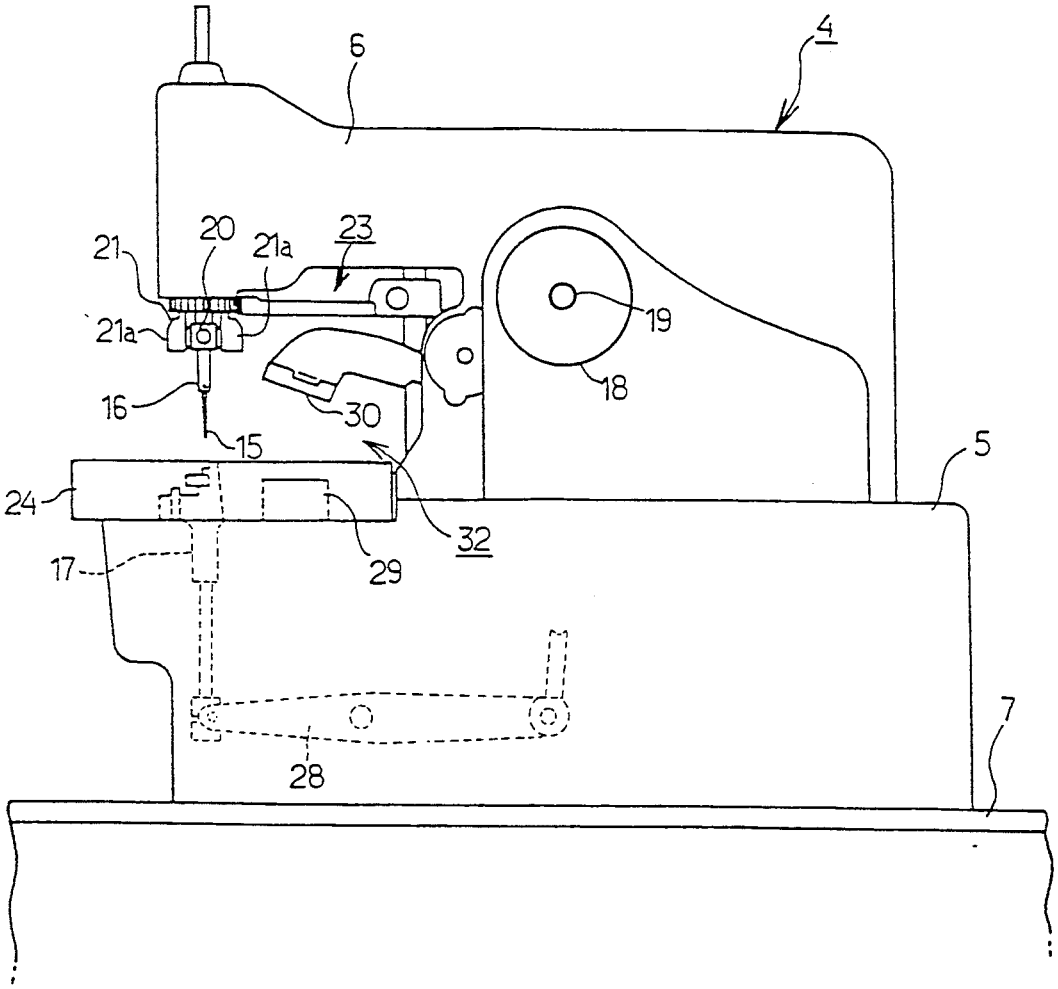
FIG. 2 is a side view of the buttonhole sewing machine.

As shown in FIGS. 1 and 2, a needle bar 16, provided at its lower end with a needle 15 is vertically movable and horizontally swingable, is provided at a free end portion of the arm 6. Provided in the bed 5 is a looper base 17 having a looper for forming stitches in cooperation with the needle 15. A driving mechanism is provided in the machine body 4 for vertically moving and horizontally swinging the needle bar 16 and also driving the looper in synchronization with the needle bar 16.

The driving mechanism will now be described. Rotation of the machine motor 8 is transmitted through a belt 35 and a pulley 18 to a main shaft 19. The main shaft 19 is provided with three cams, i.e., a needle bar vertically moving cam, a needle bar horizontally swinging cam, and a looper driving cam. Rotation of the main shaft 19 is converted into a vertical swing motion of a needle bar vertically driving lever (not shown) supported in the arm 6. As a result, the needle bar 16, connected to the needle bar vertically driving lever, is vertically driven. The rotation of the main shaft 19 is also converted into a vertical swing motion of a needle bar driving lever supported in the arm 6. As a result, a needle bar guiding member 20, connected to the needle bar swing driving lever, is vertically moved.

The needle bar guiding member 20 is loosely engaged with the needle bar 16 in such a manner as to be vertically movable and rotatable. The needle bar guiding member 20 is supported by a needle bar rotating bracket 21 rotatably supported to the free end portion of the arm 6. More specifically, a pair of side surfaces of the needle bar guiding member 20 are formed with obliquely extending grooves. On the other hand, guide pins for sliding in the grooves formed on the needle bar guiding member 20 are fixed to a pair of leg portions 21*a* of the needle bar rotating bracket 21. Accordingly, vertical movement of the needle bar guiding member 20 results in relative sliding of the guide pins of the leg portions 21*a* of the needle bar rotating bracket 21, thereby displacing the needle bar guiding member 20 sidewise relatively to the needle bar rotating bracket 21. As a result, the vertical movement of the needle bar guiding member 20 is converted into a horizontal swinging motion of the needle bar 16. On the other hand, the rotation of the main shaft 19 is also converted into a swing motion of a looper driving lever 28 provided in the bed 5. As a result, the looper connected to the looper driving lever 28 is driven so as to be synchronized with the needle bar 16.

The needle bar rotating bracket 21 and the looper base 17 are integrally rotated by an inverting motor 22 (FIG. 4) provided in the bed 5 and an inverting gear mechanism 23 partially shown in FIGS. 1 and 2. Integral rotation of the needle bar rotating bracket 21 and the looper base 17 causes a change in the swing direction of the needle bar 16 and a displacement of the looper such that it follows the needle bar 16. Accordingly, as shown in FIG. 7, the zigzag stitch 3 can be formed around the eyelet portion 2*a* of the eyelet hole 2.

As shown in FIGS. 1 to 3B, a feed table 24 for setting the work fabric 1 thereon is provided on an upper surface of the bed 5. A pair of fabric pressers 25, for pressing the work fabric to the feed table 24, are provided on an upper surface of the feed table 24. The work fabric is accordingly held between the pair of fabric pressers 25 and the upper surface of the feed table 24. The feed table 24 has a rectangular, shallow box-like shape generally open on the lower side. The upper surface of the feed table 24 is formed with a transversely elongated opening 24*a* positioned between the pair of foot pressers 25. The feed table 24 is horizontally moved in an X direction (lateral direction) and a Y direction (transverse direction) by a feeding mechanism having an X-axis pulse motor 26 and a Y-axis pulse motor 27 (FIG. 4) provided in the bed 5.

Figure 3A:
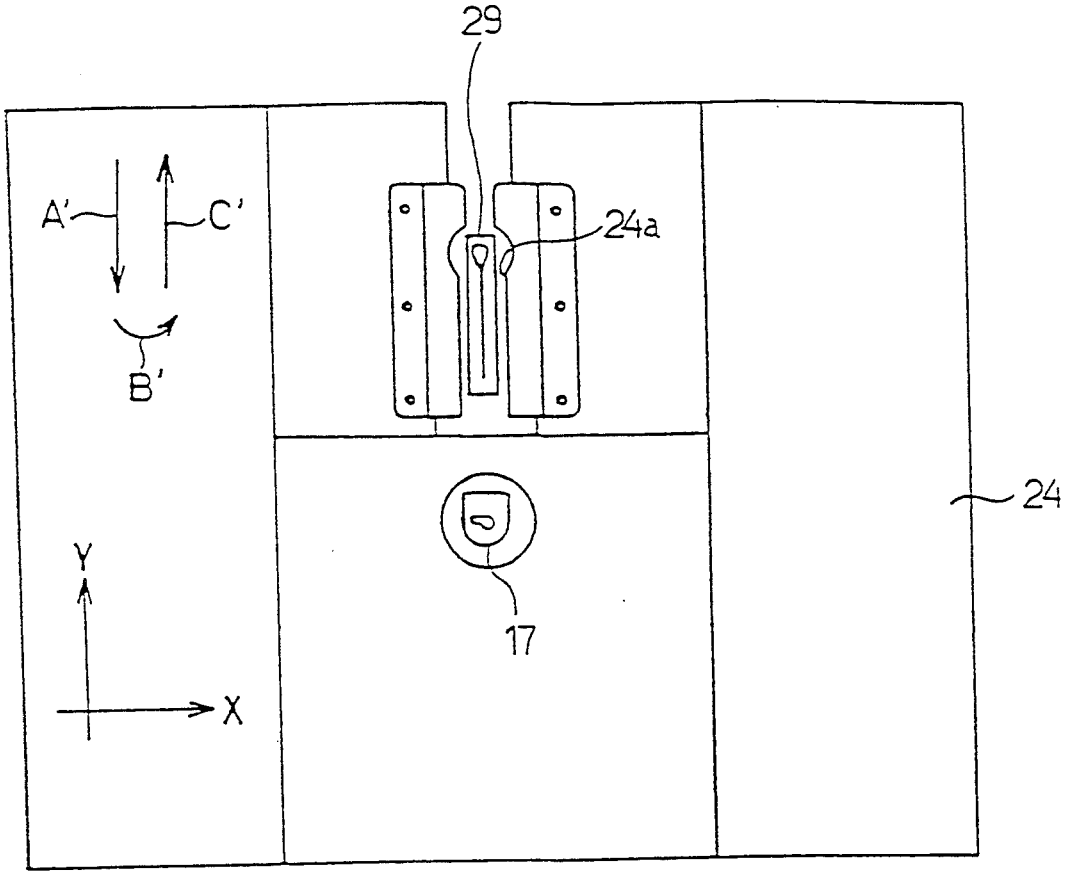
FIG. 3A is a plan view of the feed table of the buttonhole sewing machine in the buttonhole cutting position.

Further, the bed 5 is provided with a cutting mechanism 32 having a lower knife 29, a hammer 30, and an air cylinder 31. The lower knife 29 is fixed to the bed 5 at a position on the right side of the looper base 17 as viewed in FIG. 2. The hammer 30 is provided over the lower knife 29 so as to be able to come into contact with and retract from the lower knife 29. The hammer 30 is driven by the air cylinder 31 (FIG. 4) provided in the bed 5. The hammer 30 cooperates with the lower knife 29 to form the eyelet hole 2 as a cutout through the work fabric 1 as shown in FIGS. 6A, 6B, and 7. The eyelet hole 2 consists of an eyelet portion 2*a* and a straight portion 2*b* continuing to the eyelet portion 2*a*. The eyelet hole 2 is so formed as to extend in the Y direction (transverse direction). The formation of the eyelet hole 2 is carried out when the feed table 24 is brought into a knife operating position as shown in FIG. 3A. That is, when the feed table 24 is moved downwardly in the Y direction to bring the opening 24*a* of the feed table 24 into a position just over the lower knife 29, the hammer 30 is driven against the lower knife 29. The above-mentioned structure of the buttonhole sewing machine may be similar to the construction disclosed in U.S. Pat. No. 4,501,207. U.S. Pat. No. 4,501,207 is incorporated by reference.

Figure 4:
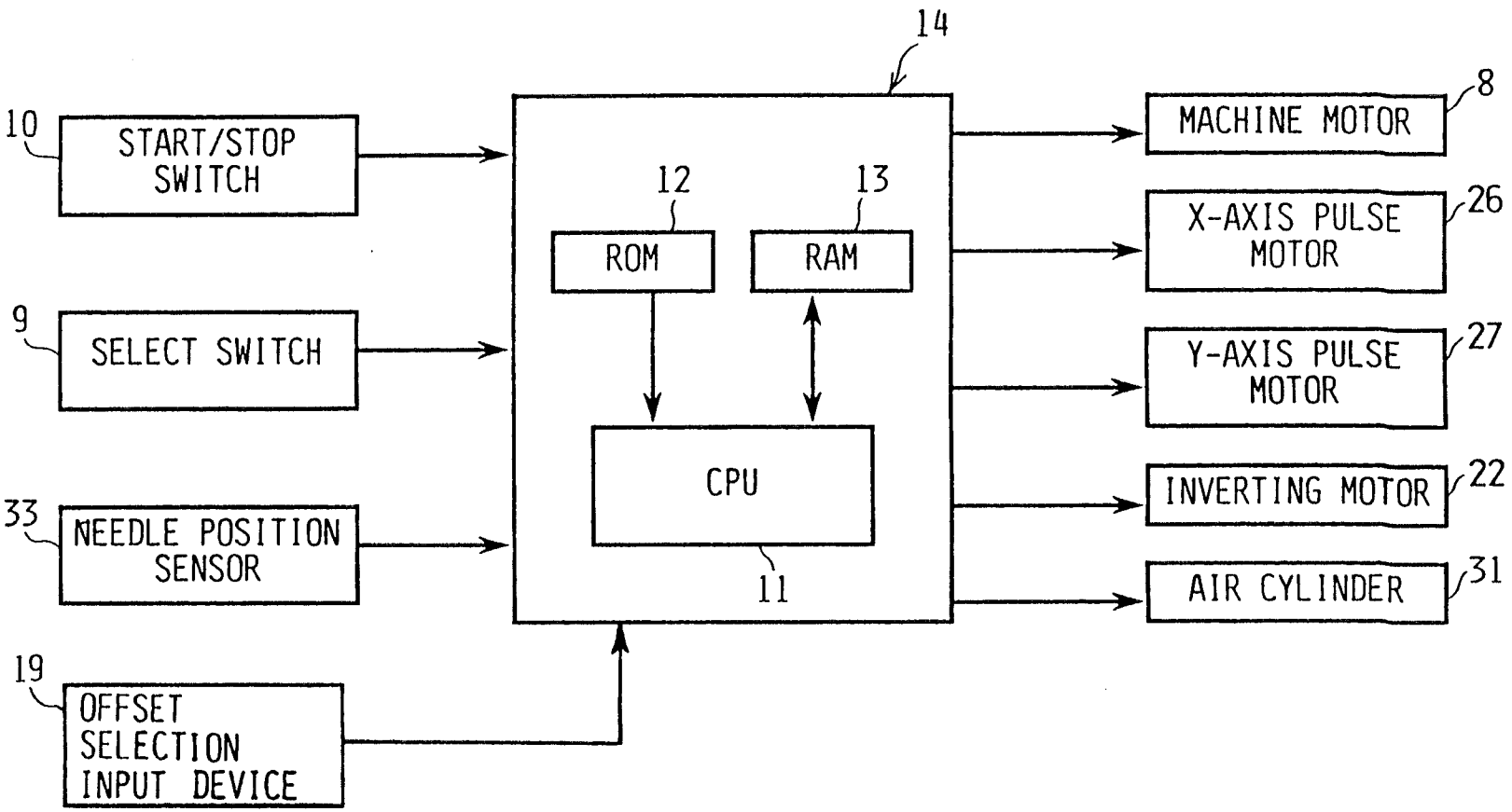
FIG. 4 is a block diagram illustrating the electrical structure of the buttonhole sewing machine.
Figure 5:
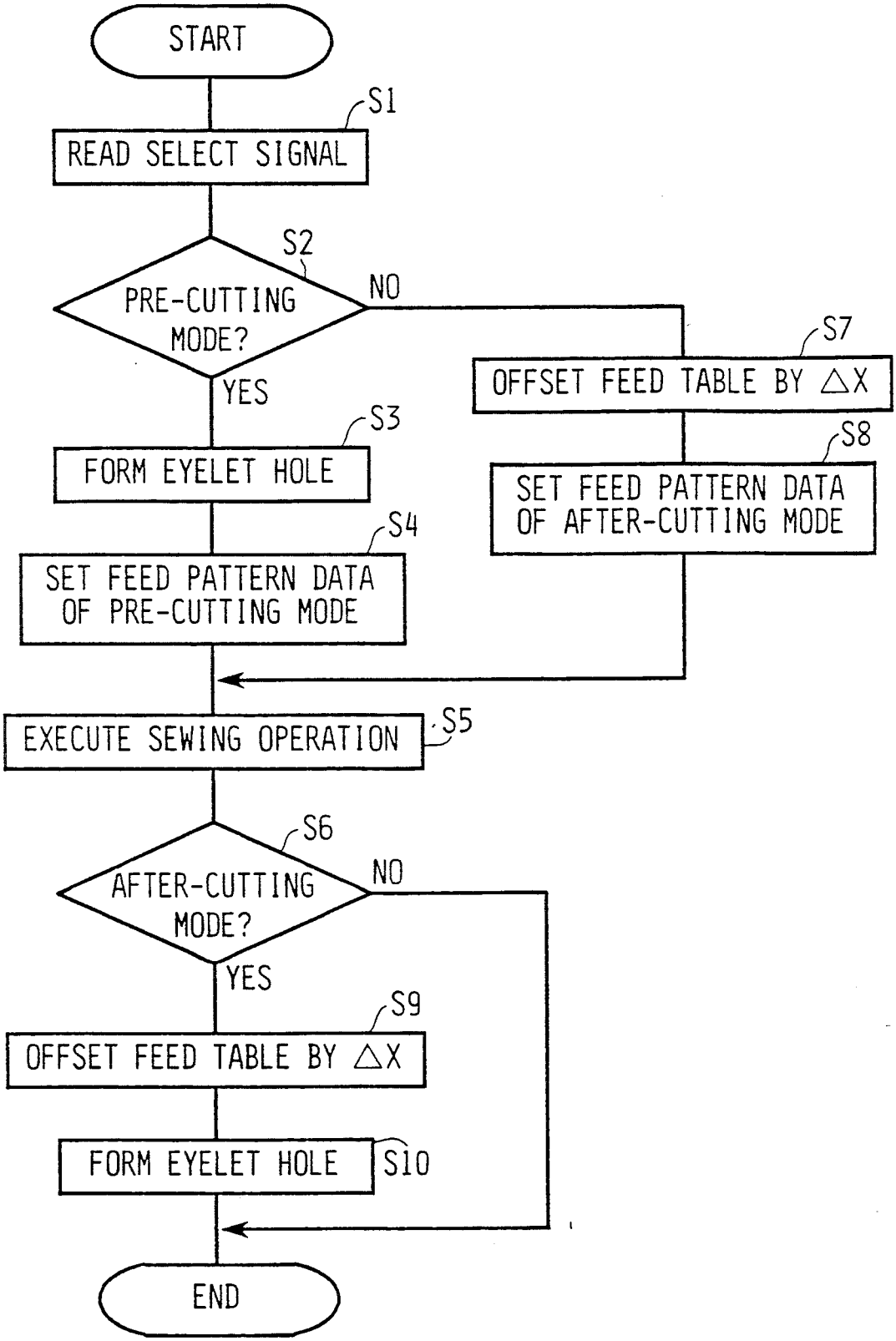
FIG. 5 is a flowchart illustrating the operation of the buttonhole sewing machine.

Next, the electrical structure of the buttonhole sewing machine according to the preferred embodiment will be described with reference to FIG. 4. The start/stop switch 10, the select switch 9, and a needle position sensor 33 are connected to the control device 14. The start/stop switch 10 supplies a start or stop signal, to the control device 14, for starting or stopping the buttonhole sewing machine. The select switch 9 supplies a select signal to the control device 14, the select signal indicating a pre-cutting mode or an after-cutting mode as selected by the operator. The needle position sensor 33 supplies a needle position signal, to the control device 14, indicating a vertical position of the needle bar 16 according to a rotational position of the main shaft 19. The control device 14 is further connected to the machine motor 8 for driving the needle bar 16 and the looper, the X-axis pulse motor 26 and the Y-axis pulse motor 27 for driving the feed table 24, the inverting motor 22 for inverting the needle rotating bracket 21 and the looper base 17, and the air cylinder 31 for driving the hammer 30.

The control device 14 includes a CPU 11, a ROM 12, and a RAM 13. The ROM 12 preliminarily stores a program for executing the operation shown by the flowchart in FIG. 5 and various data such as feed pattern data, sewing start position data, offset data, and knife operating position data. The RAM 13 temporarily stores necessary data when the CPU 11 executes the operation shown by the flowchart in FIG. 6. The CPU 11 controls the machine motor 8, the X-axis pulse motor 26, the Y-axis pulse motor 27, the inverting motor 22, and the air cylinder 31 according to the program, the feed pattern data, which are stored in the ROM 12, and the signals supplied from the start/stop switch 10, the select switch 9, and the needle position sensor 33.

When control by the CPU 11 is executed, the eyelet hole 2, consisting of the eyelet portion 2*a* and the straight portion 2*b* continuing to the eyelet portion 2*a*, is formed through the work fabric 1, set on the feed table 24 and retained by the fabric pressers 25 (FIG. 7), by the cutting mechanism 32. Further, the zigzag stitch 3 is continuously formed in the periphery of the eyelet hole 2, shown by arrows A, B, and C in FIG. 7, in order, that is, firstly on the right side of the straight portion 2*b*, secondly around the eyelet portion 2*a*, and finally on the left side of the straight portion 2*b*.

The formation of the continuous zigzag stitch 3 on the work fabric 1 is effected by simultaneously carrying out the swinging of the needle bar 16 with a predetermined zigzag width L1, the vertical movement of the needle bar 16 and the driving of the looper by the driving mechanism, and the movement of the feed table 24 along arrows A', B', and C' (see FIG. 3A) in this order by the feeding mechanism. In sewing a semi-circular portion in the periphery of an upper half of the eyelet portion 2*a*, the looper base 17 and the needle bar rotating bracket 21 are integrally inverted by the inverting motor 22 in a counterclockwise direction as viewed in top plan.

The feed pattern data stored in the ROM 12 consists of a straight portion data for sewing opposed straight portions (including a semi-circular portion in the periphery of a lower half of the eyelet portion 2*a*) on the right and left sides of the straight portion 2*b* and an eyelet portion data for sewing the semi-circular portion in the periphery of the upper half of the eyelet portion 2*a*. The straight portion data is a set of unit data indicating an X-directional feed quantity and a Y-directional feed quantity of the feed table 24 for every stitch (one stitch being formed by twice locating the needle at right and left points). The eyelet portion data is a set of unit data indicating the X-directional feed quantity and the Y-directional feed quantity of the feed table 24 for every stitch and also indicating a rotational angle of the looper base 17 and the needle bar rotating bracket 21 for every stitch.

In carrying out the sewing work, the CPU 11 first moves the feed table 24 to the sewing start position. In the preferred embodiment that is the right side at the end of the straight portion away from the eye 6, as viewed in FIGS. 6A and 6B. Then, the CPU 11 reads from the ROM 12 the feed pattern data, unit by unit, in the order of the right straight portion data, the eyelet portion data, and the left straight portion data. Thereafter, the CPU 11 controls driving quantities and driving timings of the X-axis pulse motor 26, the Y-axis pulse motor 27, and the inverting motor 22 according to the unit data read above and the needle position signal from the needle position sensor 33.

Before carrying out the sewing work, the operator operates the select switch 9 according to the kind of material of the work fabric for example, thereby selecting either the pre-cutting mode wherein the eyelet hole 2 is formed before formation of the zigzag stitch or the after-cutting mode wherein the eyelet hole 2 is formed after formation of the zigzag stitch.

In the case where the pre-cutting mode is selected, the zigzag stitch 3, as shown in FIG. 6A, is formed. That is, left needle location points b of the zigzag stitch 3 formed on the right side of the straight portion 2*b* of the eyelet hole 2 substantially coincide with right needle location points b of the zigzag stitch 3 formed on the left side of the straight portion 2*b*. Further, inside needle location points b of the zigzag stitch 3 formed in the periphery of the eyelet portion 2*a* fall inside the eyelet portion 2*a*. Accordingly, the zigzag stitch 3 formed as a whole covers a peripheral edge of the eyelet hole 2 formed through the work fabric 1.

On the other hand, in the case where the after-cutting mode is selected, the zigzag stitch 3, as shown in FIG. 6B, is formed. That is, the left needle location points b of the zigzag stitch 3 formed on the right side of the straight portion 2*b* of the eyelet hole 2 are deviated by a distance ΔX to the right side from a position where the eyelet hole 2 is to be formed later. Similarly, the right needle location points b of the zigzag stitch 3 formed on the left side of the straight portion 2*b* are deviated by the same distance ΔX to the left side from the forming position of the eyelet hole 2. Further, the inside needle location points b of the zigzag stitch 3 formed in the periphery of the eyelet portion 2*a* fall outside the eyelet portion 2*a*.

The width of the zigzag stitch 3 in both the modes, that is, the zigzag width L1 is mechanically determined by the driving mechanism. The ROM 12 preliminarily stores two kinds of eyelet portion data, that is, eyelet portion data for the pre-cutting mode and eyelet portion data for the after-cutting mode. Accordingly, the feed table 24 is moved according to each eyelet portion data. On the other hand, as to the sewing start position data and the straight portion data, the ROM 12 preliminarily stores such data for the pre-cutting mode only. Accordingly, when the pre-cutting mode is selected, the feed table 24 is moved according to the sewing start position data for the pre-cutting mode and the straight portion data for the pre-cutting mode. In contrast, when the after-cutting mode is selected, the feed table 24 is first offset by the distance ΔX leftwardly in the X direction as viewed in FIG. 3B from the sewing start position for the pre-cutting mode according to the sewing start position data for the pre-cutting mode and the offset data representing the distance ΔX, and the feed table 24 is then moved according to the straight portion data for the pre-cutting mode.

Now, there will be described the operation of the buttonhole sewing machine according to the present invention. Before starting the sewing work, the select switch 9 provided on the operation panel is operated by the operator to select either the pre-cutting mode or the after-cutting mode. Further, the work fabric 1 is set on the feed table 24 by the operator and the work fabric 1 is held on the feed table 24 by the pair of fabric pressers 25. Thereafter, when the start/stop switch 10 is turned on by the operator, a start signal is supplied from the start/stop switch 10 to the control device 14. When receiving the start signal, the CPU of the control device 14 starts to execute the buttonhole processing according to the program stored in the ROM 12. The processing to be executed by the CPU 11 will be described with reference to FIG. 5.

In step S1, the select signal from the select switch 9 is read. In step S2, it is determined which of the pre-cutting mode and the after-cutting mode has been selected. If the pre-cutting mode is selected (YES), the program proceeds to step S3. In step S3, the X-axis pulse motor 26 and the Y-axis pulse motor 27 are driven according to the knife operating position data indicating the knife operating position, thereby moving the feed table 24 to place the work fabric 1 buttonhole position over the knife operating position as shown in FIG. 3A. Then, the air cylinder 31 is driven to operate the hammer 30. As a result, the eyelet hole 2 is formed through the work fabric 1 by the cooperation of the hammer 30 and the lower knife 29. In step S4, the feed pattern data is set by combining the straight portion data and the eyelet portion data for the pre-cutting mode.

Figure 3B:
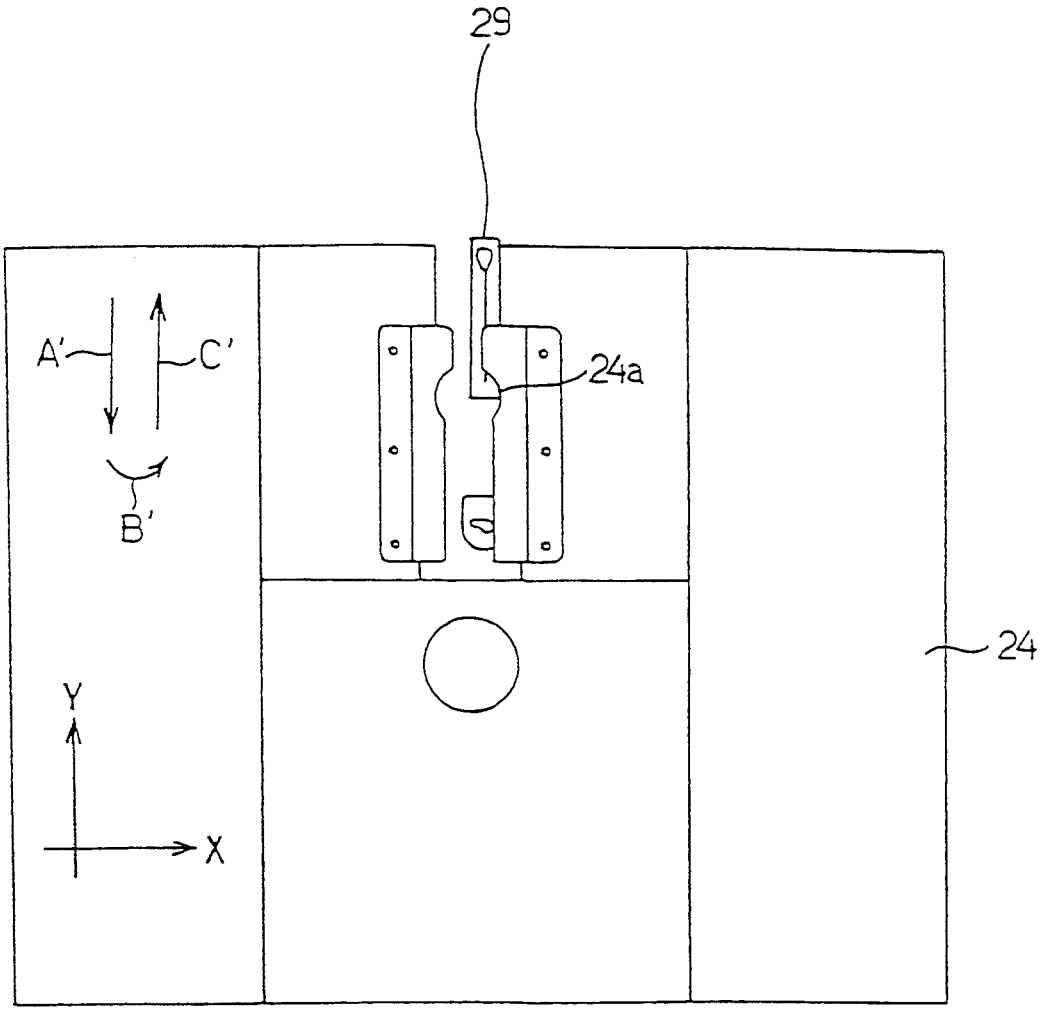
FIG. 3B is a plan view of the feed table of the buttonhole sewing machine in the buttonhole sewing position.

In step S5, the machine motor 8, the X-axis pulse motor 26, the Y-axis pulse motor 27, and the inverting motor 22 are driven to execute the sewing operation. In the sewing operation, the X-axis pulse motor 26 and the Y-axis pulse motor 27 are first driven according to the sewing start position data, with the result that the feed table 24, with work fabric 1, is moved from the knife operating position to the sewing start position as shown in FIG. 3B. Then, the machine motor 8, the X-axis pulse motor 26, and the Y-axis pulse motor 27 are driven to perform the sewing operation. As a result, while the needle bar 16 and the looper are being driven by the driving mechanism, the feed table 24 is moved in the order of the arrows A', B', and C', shown in FIG. 4, with the predetermined feed quantities specified by the feed pattern data. When the feed table 24 is moved according to the eyelet portion data of the feed pattern data, that is, when the feed table 24 is moved in the direction of the arrow B, shown in FIG. 4, the inverting motor 22 is also driven in addition to the machine motor 8, the X-axis pulse motor 26, and the Y-axis pulse motor 27. Accordingly, the zigzag stitch 3 with the zigzag width L1 is automatically formed on the work fabric in the periphery of the eyelet hole 2 in the order of the right side of the straight portion 2*b*, the periphery of the eyelet portion 2*a*, and the left side of the straight portion 2*b* as shown by the arrows A, B, and C in FIG. 7.

As shown in FIG. 6A, a center of swing of the needle bar 16 moves along a zero bight line a relative to the work fabric 1 set on the feed table 24. The left, or inside, needle location points b of the zigzag stitch 3 formed on the right side of the straight portion 2b of the eyelet hole 2 substantially coincide with the right or inside needle location points b of the zigzag stitch 3 formed on the left side of the straight portion 2b. Further, the inside needle location points b of the zigzag stitch 3 formed in the periphery of the eyelet portion 2a fall inside the eyelet portion 2a. Accordingly, the peripheral edge of the cutout, constituting the eyelet hole 2 formed through the work fabric 1, is covered with the zigzag stitch to obtain an eyelet type buttonhole with a good appearance. At the end of the movement of the feed table 24 according to the feed pattern data, the machine motor 8, the X-axis pulse motor 26, and the Y-axis pulse motor 27 are stopped to end the sewing operation and the program proceeds to step S6. In step S6, as the pre-cutting mode is selected, the answer is NO, and the processing is ended.

On the other hand, when the after-cutting mode is selected by the operator because the work fabric 1 is of a fabric material, such as a knit, which is liable to ravel, the decision in step S2 is NO, and the program proceeds to step S7. In step S7, the X-axis pulse motor 26 and the Y-axis pulse motor 27 are driven according to the sewing start position data and the offset data. That is, the feed table 24 is first moved to the sewing start position by the feeding mechanism according to the sewing start position data as shown in FIG. 3B. Then, the feed table 24 is offset by the distance ΔX leftwardly in the X direction from the sewing start position according to the offset data. Next, in step S8, the feed pattern data is set by combining the straight portion data and the eyelet portion data for the after-cutting mode, and the program proceeds to step S5.

In step S5, the machine motor 8, the X-axis pulse motor 26, the Y-axis pulse motor 27 and the inverting motor 22 are driven to execute the sewing operation. As a result, the zigzag stitch 3, with the zigzag width L1, is automatically formed on the right side of the straight portion 2b of the eyelet hole 2, around the periphery of the eyelet portion, and on the left side of the straight portion 2b. During the formation of the zigzag stitch on the right side of the straight portion 2b (corresponding to the arrow A shown in FIG. 7), the feed table 4 is moved according to the straight portion data common to that for the pre-cutting mode. At this time, the sewing start position of the feed table 24 is offset by the distance ΔX leftwardly in the X direction from the sewing start position in the pre-cutting mode. Therefore, although the straight portion data common to that for the pre-cutting mode is employed in the after-cutting mode, the zigzag stitch 3 on the right side of the straight portion 2b is formed at a position spaced by the distance ΔX rightwardly from the position where the eyelet hole 2 is to be formed, as shown in FIG. 6B.

During the formation of the zigzag stitch 3 in the periphery of the eyelet portion 2a (corresponding to the arrow B in FIG. 7), the feed table 24 is moved according to the eyelet portion data for the after-cutting mode, which is different data from the eyelet portion data for the pre-cutting mode. As a result, the inside needle location points b of the zigzag stitch 3 are arranged outside the position where the eyelet portion 2a is to be formed, and the zigzag stitch 3 is so formed as to surround the outer periphery of the eyelet portion 2a to be formed later.

Further, during the formation of the zigzag stitch 3 on the left side of the straight portion 2b (corresponding to the arrow C in FIG. 7), the feed table 24 is moved from a position where the movement of the feed table 24 according to the eyelet portion data for the after-cutting mode is ended, according to the straight portion data common to that for the pre-cutting mode. At this time, the end position of the movement of the feed table 24 according to the eyelet portion data for the after-cutting mode is offset by the distance ΔX rightwardly in the X direction from the end position in the pre-cutting mode. Therefore, the zigzag stitch 3 on the left side of the straight portion 2b is formed at a position spaced by the distance ΔX leftwardly from the position where the straight portion 2b is to be formed. In this manner, the center of swing of the needle bar 16 moves relative to the work fabric 1 set on the feed table 24 along a zero bight line a' positioned outside the zero bight line a for the pre-cutting mode. As a result, there is formed a non-sewn portion having a width of 2ΔX in the X direction between the zigzag stitch 3 formed on the right side of the straight portion 2b of the eyelet hole 2 and the zigzag stitch 3 formed on the left side of the straight portion 2b. At the end of the movement of the feed table 24 according to the feed pattern data, the machine motor 8, the X-axis pulse motor 26 and the Y-axis pulse motor 27 are stopped to end the sewing operation.

After completing the sewing operation, the program proceeds to step S6. As the after-cutting mode is now selected, the decision in step S6 is YES, and the program proceeds to step S9. In step S9, the X-axis pulse motor 26 and the Y-axis pulse motor 27 are driven, and the feed table 24 is accordingly offset by the feeding mechanism by the distance ΔX rightwardly in the X direction from the end position of the sewing operation. Then, in step S10, the X-axis pulse motor 26 and the Y-axis pulse motor 27 are driven to move the sewn buttonhole on the work fabric 1, mounted on the feed table 24, to the knife operating position as shown in FIG. 3A, and the air cylinder 31 is driven to operate the hammer 30. As a result, the eyelet hole 2 is formed through the work fabric 1 by the cooperation of the hammer 30 and the lower knife 29. In this manner, the eyelet hole 2 is formed exactly at the central position of the non-sewn portion and the processing ends.

As described above, according to the preferred embodiment, when the after-cutting mode is selected, the feeding operation of the feed table 24 during sewing is carried out with the feed table 24 offset in such a direction that the zigzag stitch 3 on the right side of the straight portion 2b of the eyelet hole 2 and the zigzag stitch 3 on the left side of the straight portion 2b are spaced apart from each other. Accordingly, although the zigzag width L1 is fixed, the non-sewn portion can be formed between the zigzag stitch 3 on the right side of the straight portion 2b and the zigzag stitch 3 on the left side of the straight portion 2b. Therefore, the operator need not carry out the troublesome work needed to adjust the zigzag width as in the prior art, but the operator can very easily select either the pre-cutting mode or the after-cutting mode by operating the select switch 9.

Furthermore, according to the above preferred embodiment, in forming the zigzag stitch 3 in the periphery of the eyelet portion 2a, different feed pattern data are used in the pre-cutting mode and in the after-cutting mode. Accordingly, the above preferred embodiment has another advantage in that it is unnecessary to offset the position of the lower knife as in the prior art.

The present invention is not limited to the above preferred embodiment, but various modifications may be made without departing from the scope of the present invention.

For instance, while the above description of the preferred embodiment has been directed to the eyelet type buttonhole sewing machine for forming the zigzag stitch 3 in the periphery of the eyelet hole 2 consisting of the eyelet portion 2*a* and the straight portion 2*b*, the present invention may be applied to a straight type buttonhole sewing machine for forming a zigzag stitch in the periphery of a straight hole.

Because, in the above preferred embodiment, the offset data representing the distance ΔX and the eyelet portion data for the after-cutting mode are stored in the ROM 12, the distance ΔX cannot be changed by the operator. However, in order to variably set the distance ΔX to a desired value, an offset data inputting device may be provided In this case, when the distance ΔX, represented by the offset data, is changed, the eyelet portion data for the after-cutting mode must be also changed. Accordingly, in the case of providing such an offset data inputting device 19, the eyelet portion data for the after-cutting mode is not stored in the ROM 12, but it may be obtained by computation using eyelet portion data for the pre-cutting mode stored in the ROM 12 and the changed offset data which would be input prior to starting sewing.

What is claimed is:

1. A buttonhole sewing machine for forming a buttonhole having a cutout and a zigzag stitch formed around a periphery of the cutout comprising:

a feeding means for moving a feed table on which a work fabric is set;

a needle bar driving means for vertically moving and horizontally swinging a needle bar having a needle at a lower end thereof;

a looper driving means for driving a looper in synchronization with said needle bar;

a cutting means for forming a cutout through the work fabric set on said feed table;

a select means for selecting one of a pre-cutting mode where the cutout is formed before formation of the zigzag stitch and an after-cutting mode where the cutout is formed after formation of the zigzag stitch;

control means for controlling said cutting means to form the cutout through the work fabric and thereafter controlling said feeding means, said needle bar driving means and said looper driving means to form the zigzag stitch having a predetermined width on opposite sides of the cutout when the pre-cutting mode is selected by said select means and controlling said feeding means, said needle bar driving means and said looper driving means to form the zigzag stitch having the predetermined width on opposite sides of a position where the cutout is to be formed and thereafter controlling said cutting means to form the cutout through the work fabric at the position when the after-cutting mode is selected by said select means; and offset means for offsetting said feed table in such a direction that stitches to be formed on the opposite sides of the position where the cutout is to be formed are spaced apart from each other, before start of a stitch forming operation, when the after-cutting mode is selected by said select means.

2. The buttonhole sewing machine according to claim 1, further comprising:

offset data storage means for storing offset data representing an offset amount.

3. The buttonhole sewing machine according to claim 2, wherein said offset means includes first offset means for offsetting said feed table in accordance with the offset data before formation of the zigzag stitch on one side of the opposite sides of the position where the cutout is to be formed, and second offset means for offsetting said feed table in accordance with the offset data after formation of the zigzag stitch on one side of the opposite sides of the position where the cutout is to be formed and before formation of the zigzag stitch on another side of the opposite sides of the position where the cutout is to be formed.

4. The buttonhole sewing machine according to claim 1, wherein said cutting means forms an eyelet hole consisting of an eyelet portion and a straight portion continuing to the eyelet portion of the cutout.

5. The buttonhole sewing machine according to claim 4, further comprising:

feed pattern data storage means for storing feed pattern data representing an amount of movement of said feed table.

6. The buttonhole sewing machine according to claim 5, wherein the feed pattern data includes straight portion data for sewing the opposite sides of the straight portion of the eyelet hole and eyelet portion data for sewing the periphery of the eyelet portion of the eyelet hole, said feed pattern data storage means stores first eyelet portion data for the pre-cutting mode, second eyelet portion data for the after-cutting mode, and common straight portion data for the pre-cutting mode and after-cutting mode.

7. A sewing machine for forming buttonholes, comprising:

a feed table for holding the work fabric;

a cutting means for cutting a buttonhole in the work fabric held on the feed table;

a sewing means having a sewing needle that reciprocates vertically and displaces horizontally and a synchronized stitch locking means for creating zig-zag stitches around the buttonhole;

a feeding means for moving said feed table to a cutting position, a sewing start position and along one of a first and a second sewing path;

a select switch for selecting a pre-cut mode where the buttonhole is cut prior to sewing and an after-cut mode where the buttonhole is defined by being sewn prior to cutting;

a start/stop switch; and a control means for controlling the sewing machine to execute one of the pre-cut and after-cut modes based upon a setting of the select switch when said start/stop switch is activated, wherein a width of said zig-zag stitches is the same for the buttonholes created in both the pre-cut and after-cut modes.

8. The sewing machine of claim 7, further comprising an offset means for following the second sewing path when the after-cut mode is selected.

9. The sewing machine of claim 7, further comprising an inverting means for permitting said sewing means to provide a constant width sewn buttonhole around a loop at one end of the buttonhole.

10. The sewing machine of claim 7, wherein when the pre-cut mode is selected, one end of the zig-zag stitches form a wall around the edge of the cut buttonhole.

11. The sewing machine of claim 8, wherein when the after-cut mode is selected, an end of the zig-zag stitches closest the cut buttonhole remain apart from the cut buttonhole.

12. The sewing machine of claim 8, further comprising an input device for setting an off-set of the zig-zag stitches in the after-cut mode.

13. The sewing machine of claim 7, wherein said control means controls said feeding means such that said feeding means moves said feed table along the first sewing path when the pre-cut mode is selected and said feeding means moves said feed table along the second sewing path when the after-cut mode is selected.

14. The sewing machine of claim 13, wherein the second sewing path is apart from the first sewing path outwardly by a predetermined distance.

15. The sewing machine of claim 14, further comprising an offset means for offsetting said feed table from the sewing start position by the predetermined distance so as to make said feed table follow the second sewing path when the after-cut mode is selected.

* * * * *